US006948569B1

(12) United States Patent
Conaway et al.

(10) Patent No.: US 6,948,569 B1
(45) Date of Patent: Sep. 27, 2005

(54) SNOW AUGER ASSEMBLY

(75) Inventors: Brian J. Conaway, Columbus, OH (US); Terry M. Birchler, New Albany, OH (US)

(73) Assignee: UnionTools, Inc., Columbus, OH (US)

( * ) Notice: Subject to any disclaimer, the term of this patent is extended or adjusted under 35 U.S.C. 154(b) by 0 days.

(21) Appl. No.: 10/943,180

(22) Filed: Sep. 16, 2004

(51) Int. Cl.[7] ..... E01H 5/02

(52) U.S. Cl. ..... 172/371; 37/196; 37/219; 37/223

(58) Field of Search ..... 37/241, 242, 244, 37/248, 249, 253, 254, 257, 258, 219, 221–223, 37/196; 172/371–373

(56) References Cited

U.S. PATENT DOCUMENTS

| | | | | | |
|---|---|---|---|---|---|
| 2,533,886 | A | * | 12/1950 | Hill | 198/659 |
| 2,692,445 | A | * | 10/1954 | Darnell | 37/251 |
| 2,768,453 | A | * | 10/1956 | Adams, Jr. | 37/252 |
| 2,769,255 | A | * | 11/1956 | Mead | 37/257 |
| 3,021,620 | A | * | 2/1962 | Rosenthal | 37/254 |
| 3,213,552 | A | * | 10/1965 | Vanvick | 37/252 |
| 3,267,594 | A | * | 8/1966 | Mattson et al. | 37/246 |
| 3,375,878 | A | * | 4/1968 | Dorn | 172/33 |
| 3,477,514 | A | * | 11/1969 | Woitas | 172/42 |
| 3,512,279 | A | * | 5/1970 | Benson | 37/244 |
| 3,583,084 | A | * | 6/1971 | Farrell | 37/245 |
| 3,742,626 | A | * | 7/1973 | Ellis | 37/260 |
| 3,758,967 | A | * | 9/1973 | Thompson | 37/242 |
| 3,913,247 | A | * | 10/1975 | Ruhl | 37/258 |
| 4,852,279 | A | * | 8/1989 | Gerbrandt | 37/252 |
| 4,920,667 | A | * | 5/1990 | Dixon | 37/285 |
| 5,353,529 | A | * | 10/1994 | McCullough | 37/142.5 |
| 5,592,760 | A | * | 1/1997 | Kohout | 37/403 |
| 6,499,237 | B2 | * | 12/2002 | Johnson | 37/251 |
| 6,643,958 | B1 | * | 11/2003 | Krejci | 37/223 |
| 2002/0062582 | A1 | * | 5/2002 | Takeuchi | 37/244 |

* cited by examiner

*Primary Examiner*—Robert E. Pezzuto
*Assistant Examiner*—Alexandra Pechhold
(74) *Attorney, Agent, or Firm*—Porter, Wright, Morris & Arthur, LLP

(57) ABSTRACT

A device for removing material from a surface includes a blade, an auger positioned in close proximity to a front side of the blade and operably mounted on an axle for rotary motion relative to the blade whereby material accumulating at the front side of the blade during movement of the blade over the surface is transversely moved from the front side of the blade to a side of the device by the rotary motion of the auger, and a handle operably connected to the blade for directing the blade and the auger over the surface. The auger has a passage receiving the axle. The auger is preferably rotatable relative to the axle and the axle is preferably rotatable relative to the blade. Preferably, the auger is molded of plastic and the passage is free of a molding draft.

22 Claims, 5 Drawing Sheets

SNOW AUGER ASSEMBLY

CROSS-REFERENCE TO RELATED APPLICATIONS

Not Applicable

STATEMENT REGARDING FEDERALLY SPONSORED RESEARCH

Not Applicable

REFERENCE TO MICROFICHE APPENDIX

Not Applicable

FIELD OF THE INVENTION

The present invention generally relates to devices for removing materials from surfaces and, more particularly, to devices for removing materials such as snow, ice, and the like from surfaces such as walkways, driveways, and the like.

BACKGROUND OF THE INVENTION

The most common snow removal devices are snow shovels and snow pushers. The snow shovel is used for both pushing and lifting snow to remove the snow from surfaces such as walkways, driveways, and the like. Snow pushers are used to push snow to remove the snow from walkways, driveways, and the like. Many varieties of snow shovels and snow pushers have been developed. However, all of these devices require a considerable amount of physical effort to accomplish the snow removal.

One solution to this problem has been the development of power-driven snow removal devices such as snow blowers, snow throwers, and the like. However, the operation of power-driven snow equipment can require as much physical effort as manual snow removal devices. Additionally, this equipment is typically more expensive to purchase, requires more storage space, and requires annual maintenance in order to stay in proper working order.

Another solution to this problem is a manual snow removing device having an auger in front of a blade. Such a device is disclosed in U.S. Pat. No. 4,920,667, the disclosure of which is expressly incorporated herein in its entirety by reference. As the user walks at a normal pace, snow that accumulates in front of the blade is automatically and immediately carried away from the blade by the auger. Thus eliminating the necessity to lift the snow as well as reducing the amount of physical effort required to push accumulated snow.

While these prior solutions have been generally successful in providing material removal devices which reduce the amount of physical effort required to remove the material, these devices are considerably more expensive to produce than traditional shovels and pushers. Additionally, there is a continuous desire to reduce manufacturing costs in the competitive industry of material removal devices. Accordingly, there is a need in the art for an improved device for removing materials.

SUMMARY OF THE INVENTION

The present invention provides a device for removing material which overcomes at least some of the above-noted problems of the related art. According to the present invention, a device for removing material comprises, in combination, a blade having a front side, an auger positioned in close proximity to the front side of the blade and operably mounted on an axle for rotary motion relative to the blade whereby material accumulating at the front side of the blade during movement of the blade over the surface is transversely moved from the front side of the blade to a side of the device by the rotary motion of the auger, and a handle operably connected to the blade for directing the blade and the auger over the surface. The auger has a passage receiving the axle. The auger is molded of plastic and the passage is free of a molding draft.

According to another aspect of the present invention, a device for removing material comprises, in combination, a blade having a front side, an auger positioned in close proximity to the front side of the blade and operably mounted on an axle for rotary motion relative to the blade whereby material accumulating at the front side of the blade during movement of the blade over the surface is transversely moved from the front side of the blade to a side of the device by the rotary motion of the auger, and a handle operably connected to the blade for directing the blade and the auger over the surface. The auger has a passage receiving the axle and is molded of plastic. The auger includes first and second pluralities of openings located on different sides of the passage, wherein the openings of each of the first and second plurality of openings are spaced-apart along the length of the passage, and wherein the openings of the first plurality of openings overlap the openings of the second plurality of openings along the length of the passage.

According to yet another aspect of the present invention, a device for removing material comprises, in combination, a blade having a front side, an auger positioned in close proximity to the front side of the blade and operably mounted on an axle for rotary motion relative to the blade whereby material accumulating at the front side of the blade during movement of the blade over the surface is transversely moved from the front side of the blade to a side of the device by the rotary motion of the auger, and a handle operably connected to the blade for directing the blade and the auger over the surface. The auger has a passage receiving the axle. The auger is rotatable relative to the axle and the axle is rotatable relative to the blade.

From the foregoing disclosure and the following more detailed description of various preferred embodiments it will be apparent to those skilled in the art that the present invention provides a significant advance in the technology of material removal devices. Particularly significant in this regard is the potential the invention affords for providing a high quality, reliable, simple, and relatively low cost assembly with improved operational performance. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
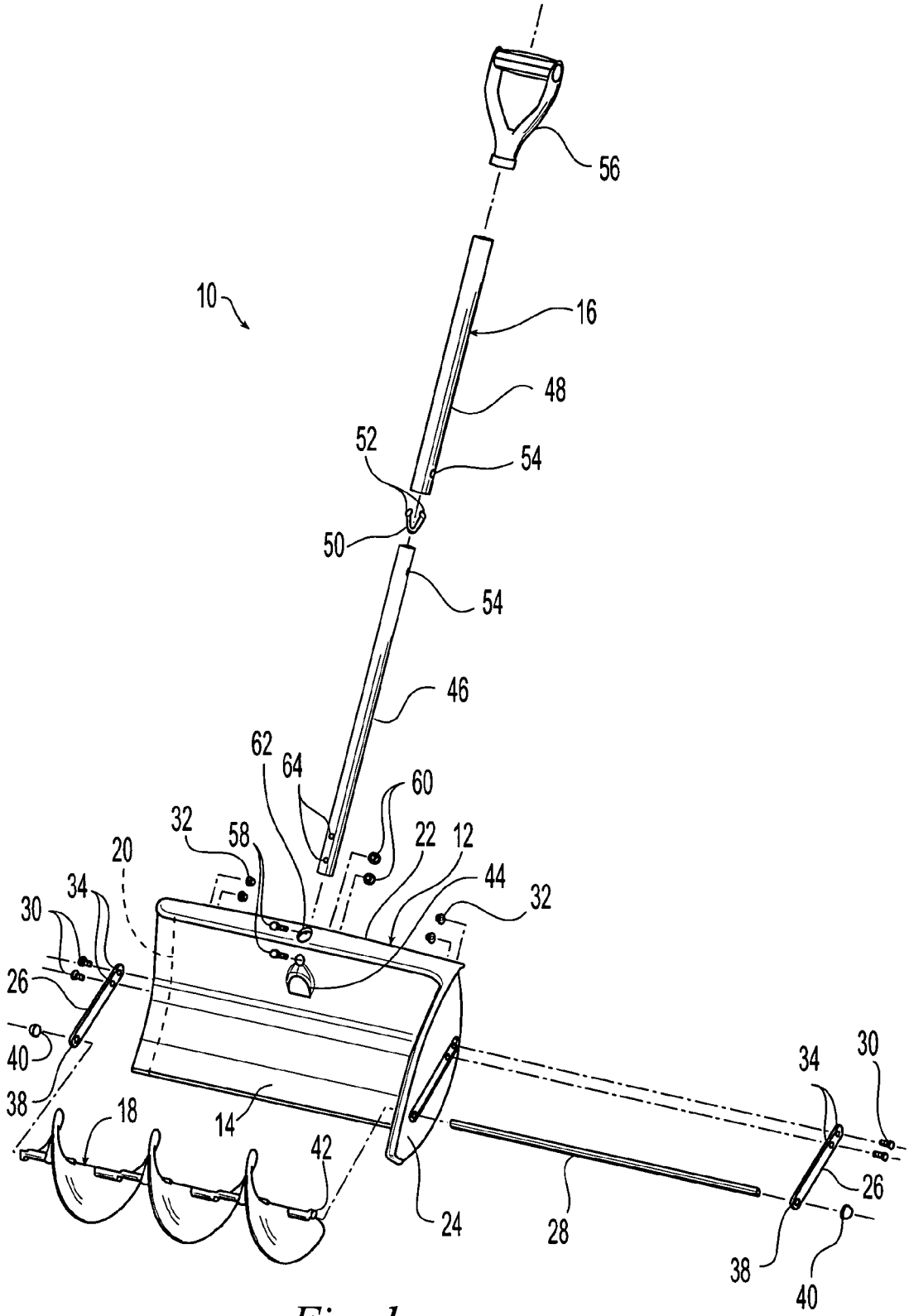
FIG. 1 is an exploded perspective view of a material removal device according to a preferred embodiment of the present invention.

It should be understood that the appended drawings are not necessarily to scale, presenting a somewhat simplified representation of various preferred features illustrative of the basic principles of the invention. The specific design features of the material removal devices as disclosed herein, including, for example, specific dimensions, orientations, and shapes of the various components will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the material removal devices illustrated in the drawings. In general, up or upward refers to an upward direction within the plane of the paper in FIGS. 1 and 2 and down or downward refers to a downward direction within the plane of the paper in FIGS. 1 and 2. Also in general, front, fore or forward refers to a direction toward the auger end of the material removal device in FIG. 1 and generally in an outward direction from the plane of the paper in FIGS. 1 and 2. Furthermore in general, aft, rear or rearward refers to a direction away from the auger end of the material removal device and generally in an inward direction into the plane of the paper in FIGS. 1 and 2.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved material removal devices disclosed herein. The following detailed discussion of various alternative and preferred embodiments will illustrate the general principles of the invention with reference to a device for removing snow, ice, or the like from surfaces such as walkways, driveways, and the like in residential or commercial environments. Other embodiments suitable for other applications will be apparent to those skilled in the art given the benefit of this disclosure.

Figure 2:
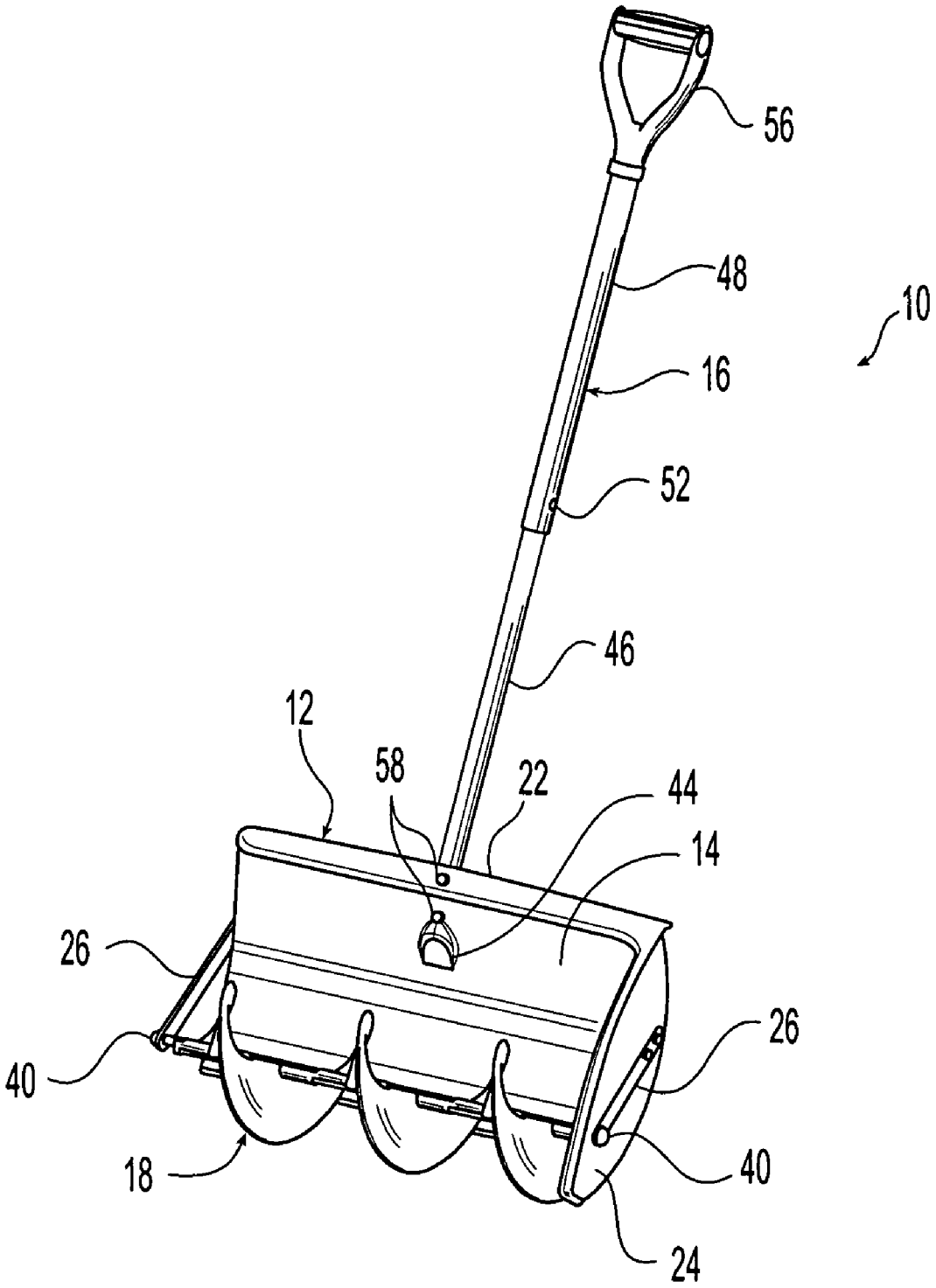
FIG. 2 is a perspective view of the material removal device of FIG. 1.
Figure 4:
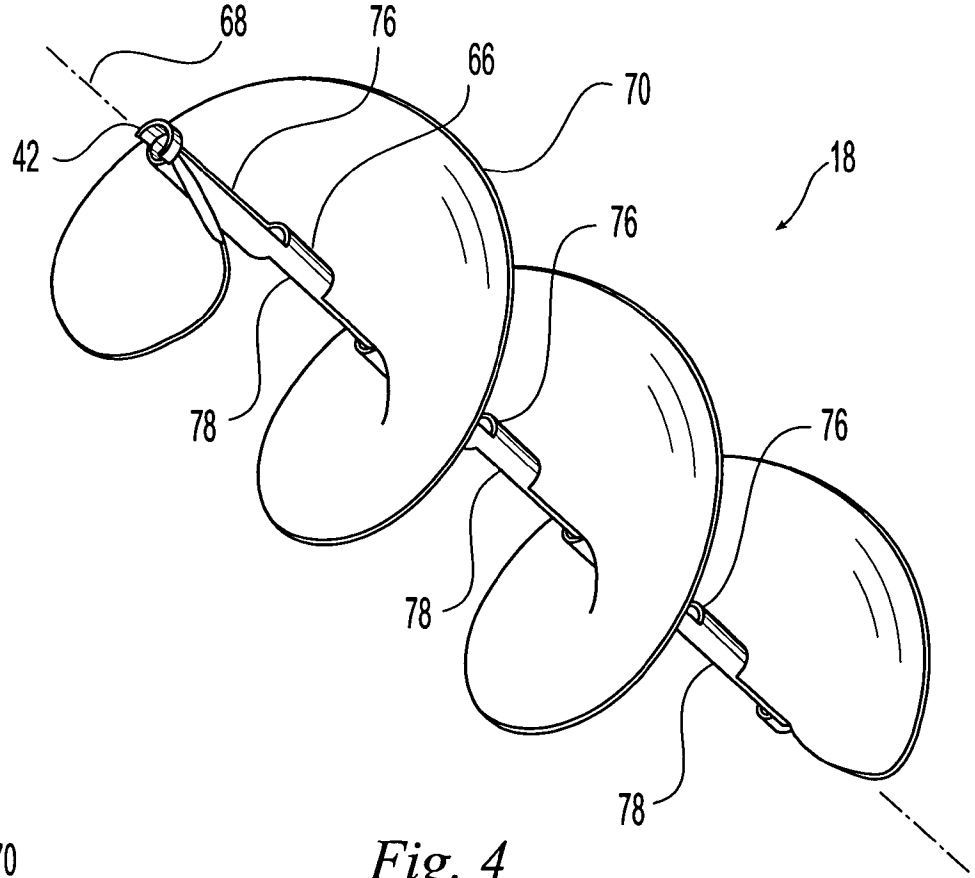
FIG. 4 is perspective view of the auger of FIG. 3.
Figure 3:
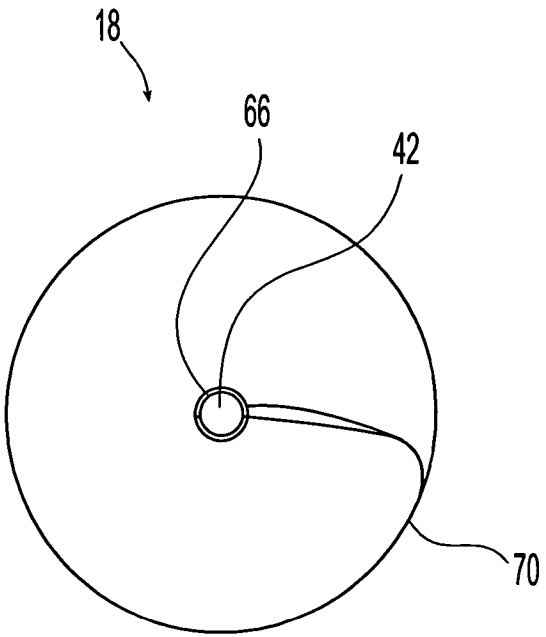
FIG. 3 is an enlarged end view of an auger of the material removal device of FIGS. 1 and 2.
Figure 5:
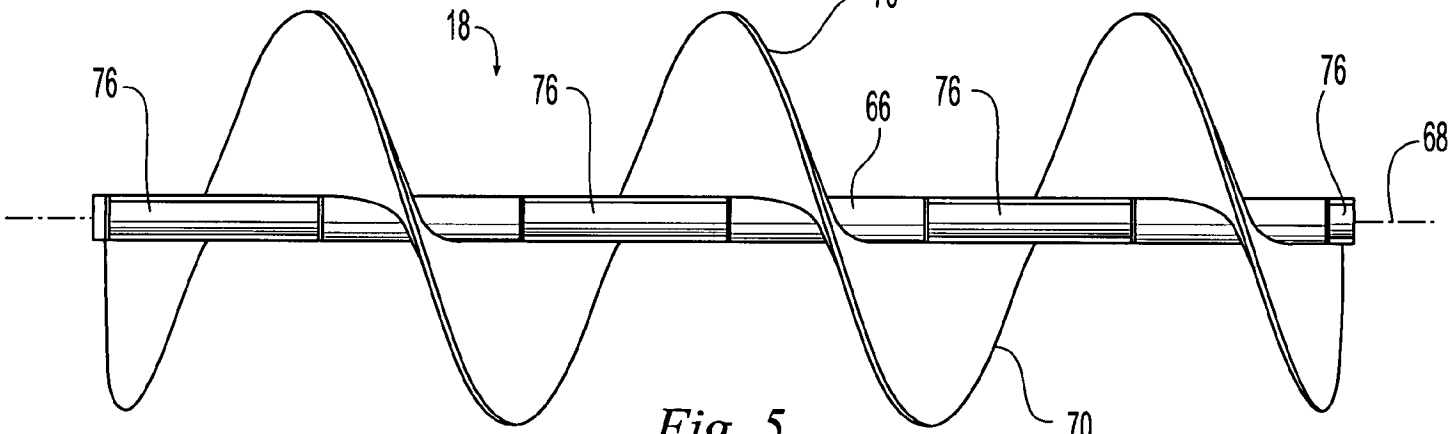
FIG. 5 is top view of the auger of FIGS. 3 and 4.
Figure 6:
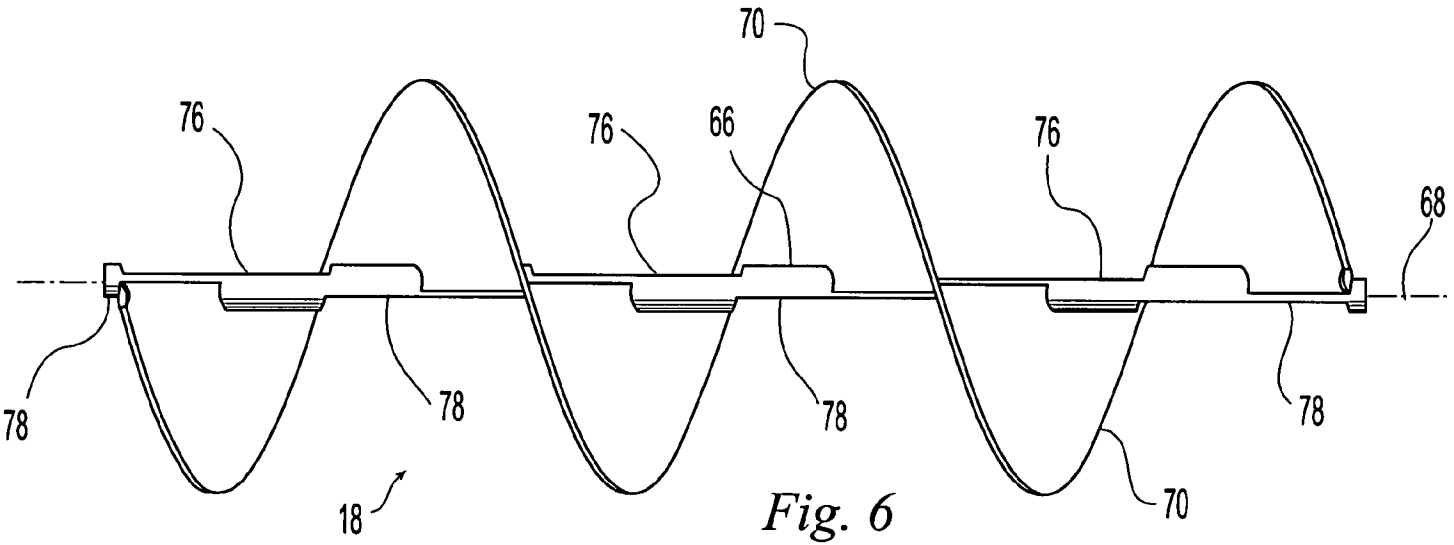
FIG. 6 is a front view of the auger of FIGS. 3 to 5.

Referring now to the drawings, FIGS. 1 and 2 illustrate a manual snow removal device 10 according to a preferred embodiment of the present invention. The illustrated manual snow removal device 10 includes a shovel body 12 forming a blade 14 for collecting material such as, for example, snow, ice and the like from a surface such as, for example, a walkway, a driveway a handle, or the like, a handle 16 operably connected to the blade 14 for grasping by a user to direct the snow removal device 10 over the surface, and a rotatable auger 18 positioned near the blade 14 for moving material collected by the blade 14 in a transverse or lateral direction away from the blade 14 and to the side of the device 10.

The illustrated shovel body 12 includes the blade 14, a side flange 20, a top flange 22, and a side wall 24. The shovel body 12 is preferably formed of a suitable plastic such as, for example, polypropylene or the like. The illustrated shovel body 12 is molded as a unitary component, that is, molded having both the blade and the support structure formed a one-piece component. It is noted, however, that the shovel body 12 can alternatively be formed by separate components secured together in a suitable manner.

The illustrated blade 14 is sized and shaped for collecting material at a forward side thereof when it is moved over the surface from which material is to be removed. The illustrated blade 14 is shaped as a snow pusher having generally parallel right and left side edges and generally parallel top and bottom edges forming a generally rectangular and concave front surface. It is noted, however, that the blade 14 can alternatively be shaped in any other suitable manner such as, for example, similar to that of a snow shovel.

The illustrated side flange 20 extends rearwardly from the right side edge of the blade 14. The illustrated top flange 22 extends rearwardly from the top edge of the blade 14. The illustrated side wall 24 extends forwardly from the left side edge of the blade 14. The side flange 20, the top flange 22, and the side wall 24 are preferably sized and shaped to improve the structural stiffness/strength of the shovel body 12. The side wall 24 is additionally sized and shaped to block or reduce transverse or lateral movement of material from the front side of the blade in a leftward direction. With the side wall 24 sized and shaped in this manner, material is primarily moved from the front side of the blade 14 in a rightward direction as described in more detail hereinafter. It is noted that the side wall 24 alternatively can be eliminated if movement of material in both directions is desired or located at the right side edge of the blade 14 if movement of material in a leftward direction is desired.

The illustrated side flange 20 and the illustrated side wall 24 are also adapted for securing axle braces or supports 26 at opposite sides of the blade 14. The illustrated axle braces 26 are generally elongate members which forwardly extend from the opposed side edges of the blade 14 to support an axle 28 of the rotatable auger 18 in front of the front surface of the blade 14. The illustrated axle braces 26 are secured to the side flange 20 and the side wall 24 by mechanical fasteners in the form of bolts 30 and lock nuts 32. The illustrated bolts 30 extend through openings 34 in the axle braces 26 and cooperating openings 36 in the side flange 20 and the side wall 24. It is noted that the axle braces 26 can alternatively be secured to the shovel body 12 in any other suitable manner or can alternatively be formed unitary with the shovel body 12. The illustrated axle braces 26 are formed of a metal such as, for example, plated steel, but can alternatively be formed of any other suitable material.

The forward end of each of the illustrated axle braces 26 are provided with openings 38 for rotatably receiving and supporting the axle 28 therein such that the axle 28 is freely rotatable relative to the axle braces 26 and the shovel body 12. The illustrated axle 28 is retained within the openings 38 by press nuts 40 secured to the ends of the axle 28. It is noted, however, that the axle 28 can alternatively be retained within the openings 38 in any other suitable manner. The illustrated axle 28 is in the form of an elongate tube but alternatively can be formed in any other suitable manner such as, for example, an elongate solid rod. The illustrated axle 28 is formed of steel but any other suitable material can alternatively be utilized.

The illustrated axle 28 extends through an axle passage 42 of the auger 18 such that the auger 18 is freely rotatable relative to the axle 28 and the shovel body 12. Therefore, the illustrated auger 18 has two degrees of rotational freedom relative to the shovel body 12 and the blade 14: (1) the auger 18 is freely rotatable relative to the axle 28; and (2) the axle 28 is freely rotatable relative to the axle braces 26 and the shovel body 12. It is noted that alternatively the auger 18 can be secured to the axle 28 or the axle 28 can be secured to the axle braces 26 such that the auger 18 has a single degree of rotational freedom relative to the shovel body 12 and the blade 14. It is noted, however, that having the two degrees of freedom provides addition protection against "lock-up" or "jamming" of the auger 18 during use which prevents rotation of the auger 18 due to the build-up of material such as snow and/or ice. With the auger 18 mounted on the axle 28, the auger 18 is located in close proximity to the front side of the blade 14 and extending in a transverse or lateral direction, that is, the longitudinal axis of the auger 18 is substantially parallel to the front surface of the blade 14.

The illustrated shovel body 12 also includes a socket 44 at a rearward side thereof for attaching the handle 16 to the shovel body 12. The illustrated socket 44 is sized and shaped for receiving the lower end of the handle 16 therein as described in more detail hereinafter. The illustrated socket 44 is formed unitary with the shovel body 12 but alternatively can be a separate component secured thereto.

The illustrated handle 16 is generally elongate and includes telescoping first and second tubular members 46, 48. The members 46, 48 are sized and shaped so that they are selectively movable between a retracted or storage configuration (not shown) wherein the tubular members 46, 48 are retracted to reduce the length of the handle 16 for shipping and storage and an extended or use configuration (shown in FIG. 2) wherein the tubular members 46, 48 are extended to increase the length of the handle 16 for use. It is noted that the handle 16 can alternatively be formed by a single elongate member if desired. The illustrated handle 16 also includes a spring clip 0 having a pair of opposed buttons or protrusions 52 which cooperate with openings 54 in the tubular members 46, 48 to releasably lock the tubular members 46, 48 in the extended configuration. It is noted that the tubular members 46, 48 can alternatively be secured in any other suitable manner. The illustrated tubular members 46, 48 are formed of powder coated steel but alternatively the tubular members, or alternatively a single elongate member, can be formed of any other suitable material such as, for example, aluminum, plastic, fiberglass, wood, or the like. The illustrated handle 16 also includes a D-grip handle member 56 secured to the free or upper end of the second tube member 48 but alternatively can be formed unitary therewith. The illustrated D-grip handle member 56 is molded of suitable plastic such as polyethylene but alternatively can be formed of any other suitable material. It is noted that the handle member 56 can alternatively have any other suitable shape or can alternatively be eliminated if desired.

The lower end of the illustrated handle 16 extends into the socket 44 located at the rear of the shovel body 12. The illustrated handle 16 is secured to the shovel body 12 by mechanical fasteners in the form of bolts 58 and lock nuts 60. The illustrated bolts 58 extend through openings 62 in the shovel body 12 and cooperating openings 64 in the handle 16. It is noted that the handle 16 can alternatively be secured to the shovel body 12 in any other suitable manner or can alternatively be formed unitary with the shovel body 12.

As best shown in FIGS. 3 to 6, the rotatable auger 18 has an elongate shaft portion 66 having a central longitudinal axis forming a rotational axis 68 for the auger 18 and a helical flight portion 70 formed about the shaft portion 66. The shaft portion 66 forms the axle passage 42 coaxial with the rotational axis 68 of the auger 18. The illustrated axle passage 42 is sized and shaped to rotatably receive the axle 28 therein. The flight portion 70 is sized and shaped to convey material along the longitudinal or rotational axis 68 of the auger 18 (this is the transverse or lateral direction of the snow removal device 10 because the auger 18 is mounted to the shovel body 12 in a transverse direction). The illustrated flight portion 70 has a pitch such that counter-clockwise rotation of the auger 18 (when viewed from the left end of the auger 18) moves material toward the right side of the snow removal device 10 away from the side wall 24 and toward the open right side of the shovel body 12. It is noted that the auger 18 can alternatively be provided with a reverse pitch to convey material toward the left side of the snow removal device 10 or a dual pitch to convey material to both sides of the snow removal device 10.

The auger 18 is preferably formed of a suitable plastic such as, for example, Nylon or the like. The illustrated auger 18 is molded as a unitary component, that is, molded having the shaft portion 66 and the flight portion 70 formed as a one-piece component. It is noted, however, that the shaft portion 66 and the flight portion 70 can alternatively be formed by separate components secured together in a suitable manner.

Figure 7:
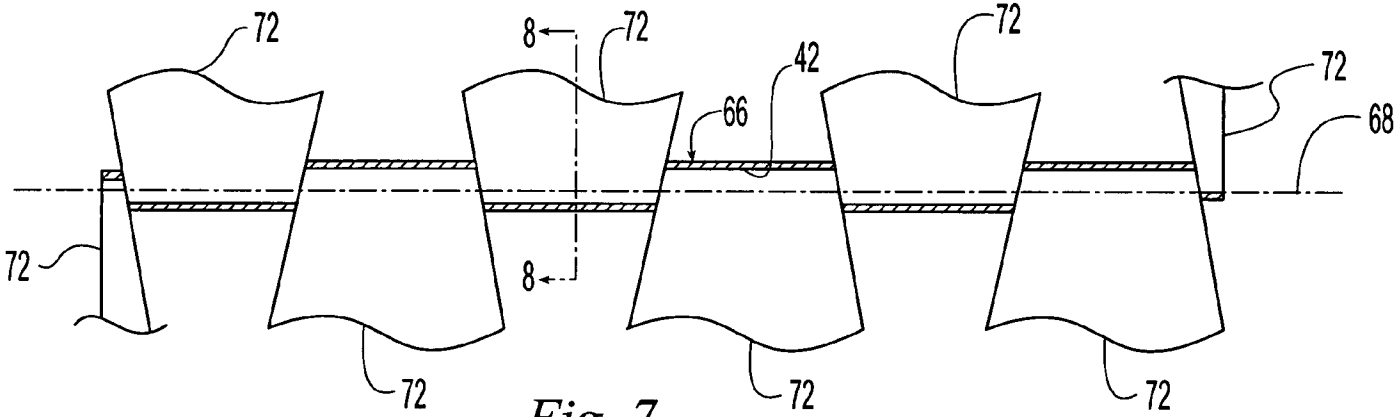
FIG. 7 is cross-sectional view of the auger of FIGS. 3 to 6 showing the formation of an axle passage using a bypass molding process.
Figure 8:
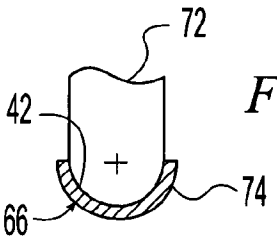
FIG. 8 is an enlarged cross-sectional view taken from line 8—8 of FIG. 7.

As best shown in FIGS. 7 and 8, the illustrated auger 18 is formed with a bypass molding process. The illustrated axle passage 42 is formed by a plurality of mold or core members 72 which extend into a mold from opposite sides in an alternating manner to collectively form the axle passage 42 that extends the entire length of the auger shaft portion 66. The mold members 72 engage each other in the longitudinal direction of the auger 18 so that the resulting axle passage 42 is continuous. The sides of the illustrated mold members 72 have cooperating drafts of about 10 degrees to about 12 degrees. Ends 74 of the mold members 72 are rounded so that they collectively form the circular cross-sectional shape of the axle passage 42. Once the auger 18 is molded, the mold members 72 forming the axle passage 42 are withdrawn so that the axle passage 42 extends the length of the auger 18.

Figure 9:
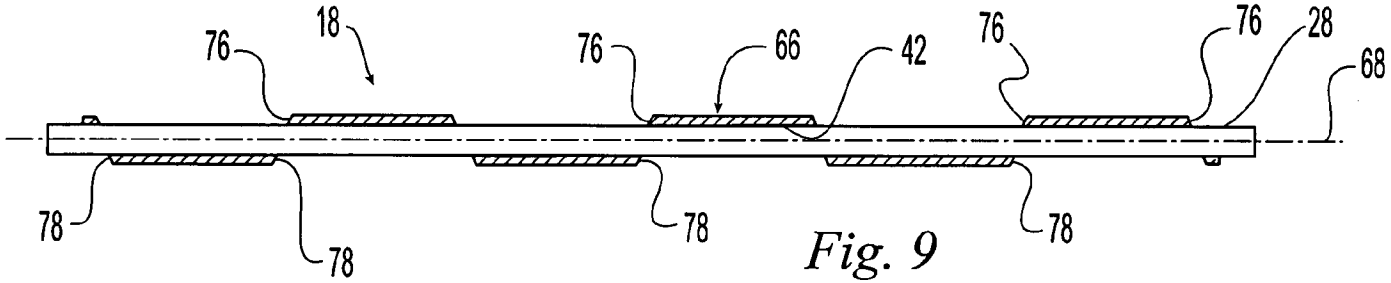
FIG. 9 is a cross-sectional view of the auger of FIGS. 3 to 6 similar to FIG. 7 but showing an axle located within the axle passage.

As best shown in FIG. 9, once the mold members 72 are withdrawn, the shaft portion 66 includes first and second plurality of openings 76, 78 located on opposites sides of the shaft portion 66. The openings 76, 78 each open into the axle passage 42. The openings 76, 78 are longitudinally spaced-apart along the length of the shaft portion 68 (this is the lateral or transverse direction of the snow removal device 10). The openings of the first plurality of openings 76 also overlap the openings of the second plurality of openings 78 in the longitudinal direction of the shaft portion 68 of the auger 18. The illustrated axle passage 42, therefore, is formed by a series of alternating shaft portion segments which are generally "C-shaped" in cross-section. The illustrated openings 76, 78 and the flight portion 70 are each sized and shaped so that the openings 76, 78 do not interfere with or interrupt the flight portion 70. It is noted that the illustrated axle passage 42 has a substantially constant diameter because it can be molded free of a draft. Note that a draft is required to pull a mold pin from a passage after shrinkage of the molded material. Thus, the illustrated axle passage 42 receives the axle 28 in a close but rotatable manner throughout the length of the shaft portion 68 to reduce the amount of "wobble" and thus component wear during use.

Prior to use, the user moves the handle 16 to the extended configuration if the handle 16 is in the retracted configuration for storage. The handle 16 is moved into the extended configuration by grasping both the first and second tubular members 46, 48 and pulling the second tubular member 48 upward until the spring clip 50 resiliently snaps into the openings 54 to releasably lock the tubular members 46, 48 together in the extended configuration. To remove snow or the like from the surface, the user grasps the handle 16 and pushes the snow removal device 10 over the surface. As the device is pushed over the surface, snow accumulates at the front surface of the blade 14 and the rotating auger 18 moves accumulated snow in a rightward direction. Because the snow is moved to the side of the device 10 and does not continuously build up in front of the blade 14, a relatively low amount of effort is required to push the device 10. Additionally, the smooth rotation of the auger 18 provided by the draft free axle passage 42 and the two degrees of rotational freedom of the rotating auger 18 each add to the low amount of effort required to push the device 10. The user continues to make passes across the surface until the snow is moved to a desired location. After use, if the user desires to store the handle 16 in the retracted configuration, the user inwardly depresses the buttons 52 of the spring clip 50 until the tubular members 46, 48 can be telescoped to the retracted configuration.

From the foregoing disclosure and detailed description of certain preferred embodiments, it will be apparent that various modifications, additions and other alternative embodiments are possible without departing from the true scope and spirit of the present invention. For example, the disclosed manual devices could be modified to be power-driven devices. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A device for removing material from a surface comprising, in combination:

a blade having a front side;

an auger positioned in close proximity to the front side of the blade and operably mounted on an axle for rotary motion relative to the blade whereby material accumulating at the front side of the blade during movement of the blade over the surface is transversely moved from the front side of the blade to a side of the device by the rotary motion of the auger;

a handle operably connected to the blade for directing the blade and the auger over the surface;

wherein the auger has a passage receiving the axle;

wherein the auger is molded of plastic and the passage is free of a molding draft;

wherein the auger is formed by bypass molding; and wherein the auger includes first and second pluralities of openings located on different sides of the passage, wherein the openings of each of the first and second plurality of openings are spaced-apart along the length of the passage, and wherein the openings of the first plurality of openings overlap the openings of the second plurality of openings along the length of the passage.

2. The device according to claim 1, wherein the passage has a substantially constant diameter.

3. The device according to claim 1, wherein the blade is molded of plastic and the axle is supported by a pair of metal braces secured to the blade.

4. The device according to claim 1, wherein the handle is secured directly to the blade.

5. The device according to claim 1, wherein the auger is rotatable relative to the axle and the axle is rotatable relative to the blade to provide the auger with two degrees of rotational freedom and whereby the auger remains rotatable relative to the blade when build-up of material prevents either one of the two degrees of rotational freedom of the auger.

6. A device for removing material from a surface comprising, in combination:

a blade having a front side;

an auger positioned in close proximity to the front side of the blade and operably mounted on an axle for rotary motion relative to the blade whereby material accumulating at the front side of the blade during movement of the blade over the surface is transversely moved from the front side of the blade to a side of the device by the rotary motion of the auger;

a handle operably connected to the blade for directing the blade and the auger over the surface;

wherein the auger has a passage receiving the axle;

wherein the auger is molded of plastic; and wherein the auger includes first and second pluralities of openings located on different sides of the passage, wherein the openings of each of the first and second plurality of openings are spaced-apart along the length of the passage, and wherein the openings of the first plurality of openings overlap the openings of the second plurality of openings along the length of the passage.

7. The device according to claim 6, wherein the passage is free of a molding draft.

8. The device according to claim 6, wherein the auger is formed by bypass molding.

9. The device according to claim 6, wherein the passage has a substantially constant diameter.

10. The device according to claim 6, wherein the blade is molded of plastic and the axle is supported by a pair of metal braces secured to the blade.

11. The device according to claim 10, wherein the handle is secured directly to the blade.

12. The device according to claim 6, wherein the auger is rotatable relative to the axle and the axle is rotatable relative to the blade to provide the auger with two degrees of rotational freedom and whereby the auger remains rotatable relative to the blade when build-up of material prevents either one of the two degrees of rotational freedom of the auger.

13. A hand-powered device for removing material from a surface comprising, in combination:

a blade having a front side;

an auger positioned in close proximity to a front side of the blade and operably mounted on an axle for rotary motion relative to the blade whereby material accumulating at the front side of the blade during movement of the blade over the surface is transversely moved from the front side of the blade to a side of the device by the rotary motion of the auger;

a handle operably connected to the blade for directing the blade and the auger over the surface;

wherein the auger has a passage receiving the axle;

wherein the auger is rotatable relative to the axle and the axle is rotatable relative to the blade to provide the auger with two degrees of rotational freedom; and whereby the auger remains rotatable relative to the blade when build-up of material prevents either one of the two degrees of rotational freedom of the auger.

14. The device according to claim 13, wherein the auger is molded of plastic and the axle is formed of metal.

15. The device according to claim 14, wherein the blade is molded of plastic and the axle is supported by a pair of metal braces secured to the blade.

16. The device according to claim 13, wherein the blade is molded of plastic and the axle is supported by a pair of metal braces secured to the blade.

17. The device according to claim 16, wherein the handle is secured directly to the blade.

18. The device according to claim 13, wherein the auger is formed by bypass molding.

19. An auger for a snow removal device comprising, in combination:

a shaft portion having a central longitudinal axis forming a rotational axis for the auger;

a helical flight portion formed about the shaft portion;

wherein the shaft portion forms a passage coaxial with the rotational axis;

wherein the auger is molded of plastic; and wherein the shaft portion forms first and second pluralities of openings located on different sides of the passage, wherein the openings of each of the first and second plurality of openings are spaced-apart along the length of the passage, and wherein the openings of the first plurality of openings overlap the openings of the second plurality of openings along the length of the passage.

20. The auger according to claim 19, wherein the passage is free of a molding draft.

21. The auger according to claim 19, wherein the auger is formed by bypass molding.

22. The auger according to claim 19, wherein the passage has a substantially constant diameter.

* * * * *